US005538798A

United States Patent [19]

Sheehan

[11] Patent Number: 5,538,798

[45] Date of Patent: Jul. 23, 1996

[54] INVESTMENT CASTING GATING FOR METAL WOOD GOLF CLUB HEADS

[75] Inventor: John P. Sheehan, Covina, Calif.

[73] Assignee: Niemin Porter & Co. d/b/a Cast Alloys, Inc., Northridge, Calif.

[21] Appl. No.: 420,659

[22] Filed: Apr. 12, 1995

[51] Int. Cl.[6] ..... A63B 53/04

[52] U.S. Cl. ..... 428/577

[58] Field of Search ..... 428/577, 582, 428/583, 586; 273/167 H, 167 R, 173

[56] References Cited

U.S. PATENT DOCUMENTS

| | | | |
|---|---|---|---|
| 3,900,064 | 8/1975 | Chandley et al. | 164/363 |
| 4,472,092 | 9/1984 | Schmidt | 164/65 |
| 4,558,505 | 12/1985 | Moore | 29/527.6 |
| 4,577,669 | 3/1986 | Schimidt et al. | 164/246 |
| 4,630,825 | 12/1986 | Schmidt et al. | 273/167 H |
| 4,651,799 | 3/1987 | Chandley | 164/35 |
| 4,842,243 | 6/1989 | Butler | 164/342 |
| 5,056,705 | 10/1991 | Wakita et al. | 273/167 H |
| 5,131,986 | 7/1992 | Harada et al. | 205/67 |
| 5,204,046 | 4/1993 | Schmidt | 264/328.1 |
| 5,219,408 | 6/1993 | Sun | 164/76.1 |
| 5,261,478 | 11/1993 | Sun | 164/137 |
| 5,294,037 | 3/1994 | Schmidt | 228/125 |
| 5,346,218 | 9/1994 | Wyte | 273/167 H |
| 5,429,365 | 7/1995 | McKeighen | 273/167 H |

FOREIGN PATENT DOCUMENTS

| | | | |
|---|---|---|---|
| 4-2376 | 1/1992 | Japan | 273/167 R |

*Primary Examiner*—John Zimmerman

*Attorney, Agent, or Firm*—Locke Purnell Rain Harrell; Randall C. Brown; James F. Struthers

[57] ABSTRACT

Apparatus and directed to improved gating for the investment casting of metal wood golf club heads.

3 Claims, 2 Drawing Sheets

INVESTMENT CASTING GATING FOR METAL WOOD GOLF CLUB HEADS

BACKGROUND OF THE INVENTION

1. Field of the Invention

The present invention relates to improved gating for investment casting of metal wood golf club heads.

2. Description of Related Information

During the 1970's, advancements in investment casting technology led to the production of thin-walled, hollow golf clubs commonly referred to as "metal woods." The traditional "wood" golf club heads in use at the time were constructed from various types of wood or wood laminates, and required a solid or near-solid product. Hollow metal heads offered distinct advantages in playability over the traditional wooden clubs and, as a result, they have almost completely replaced traditional wooden clubs.

A metal wood golf club head typically comprises a main body having a hollow interior. The main body is characterized by a "face," the portion that strikes a golf ball, a "heel" and a "toe" on opposite ends of the face, an upper surface, or "crown," and a "ribbon" extending around and below the crown between the toe and the heel. The curvature of the face is characterized by its "bulge," or side-to-side curvature, and its "roll," or top-to-bottom curvature.

An orifice bounded by the lower portion of the face, heel, toe and ribbon opens into the hollow interior of the main body and is covered by a "sole plate." The sole plate is welded to the body at the orifice rim (hereinafter, the "weld rim"). The golf club head also has a hosel for connection to a club shaft, either extending from the exterior surface of the main body or incorporated within the body itself.

The primary production technique used to manufacture metal woods is investment or "lost wax" casting. For investment casting of ferrous and nonferrous golf club heads, static, gravity-driven, air-cooled investment casting, requiring no vacuum chamber, is typically employed.

According to the lost wax technique, tooling is constructed in the shape of the desired product and hot wax is injected into the tooling to form a three dimensional likeness or "pattern" in wax of the desired product. The wax pattern is affixed to a wax mold assembly, which is repeatedly dipped in a ceramic slurry and stuccoed with sand. This process "invests" or surrounds the wax assembly with a shell of hard ceramic.

When an adequately strong ceramic shell has been completed, the ceramic mold is fixed in an autoclave where the wax pattern is melted and removed via heat and steam, leaving a hollow ceramic impression of the entire assembly. The ceramic shell is then preheated, after which molten metal is poured therewithin, thus replacing and duplicating the original wax mold assembly. When the metal has cooled, the ceramic is shaken loose from the metal leaving a positive metal duplicate of the original wax part and assembly.

The molten metal is introduced into the mold assembly through an integral cup and is distributed to and through the ceramic mold through a manifold and channels. Gating channels are formed in the mold by incorporating "gates" into the wax pattern or assembly before the dipping process begins. The gates are wax bodies arranged in a desired flow pattern.

Gates may be created by the tooling or may be added by wax welding after the initial wax pattern is formed. Each gate extends from the wax pattern to a "runner bar," which is a positive wax manifold connecting the gates to the cup. When the wax gates and runner bar are melted and removed after dipping, a manifold and tributary channels remain, through which molten metal may travel.

In final processing, the unfinished metal head is cut free from the positive metal duplicate of the mold assembly, the metal which filled the gating channels is cut off, and the remaining material is ground and polished to form a finished golf club head.

Because the gating arrangement governs the distribution pattern and rate for molten metal as it is introduced, it also affects the cooling rate and the structure of the club head. In this regard, an even cooling pattern proceeding from the outside to the inside of the head produces a fine, even grain structure which is desirable for cosmetic and structural reasons.

A poor metal distribution profile can result in the "pitting" of a club head, weakening the part and requiring additional welding and polishing for cosmetic reasons. Pitting results from "shrink," which is associated with metal cooling. Shrink occurs where molten metal is trapped in a pocket, surrounded by cooler metal. Because the volume of metal decreases as it cools, the volume of the molten metal decreases. When there is no longer sufficient molten metal to fill the original pocket, a void or cavity can form and pitting can result.

In the past, gating for hollow metal wood golf club heads consisted of a solitary gate applied to the heel area of the club or, occasionally, to the toe area. Although this gating enjoyed relatively uncomplicated final processing, the use of a solitary gate restricted flow of metal into the product and could not ensure a tight grain or a good casting surface where used in conjunction with thinner heads.

Because solitary gates were not suited to increasing cosmetic quality and structural demands, secondary gates were added to the toe, crown and ribbon of the wax pattern to accomplish even distribution of metal flow and to control the solidification of the metal. As the quality race escalated, and the size of club heads increased (drivers especially), the number of gates required to maintain cosmetic and structural standards increased as well, being driven by the size and complexity of the club head being produced. In the past, a minimum of three gates and often as many as nine gates were required to meet quality standards.

While metal distribution control was accomplished to some extent through additional gating, penalties were seen in increasingly complex manufacturing. For example, gates on the toe, ribbon, and crown cannot be incorporated into a tool, but must be wax welded to the wax pattern. Because the gates must be cleaned and prepared before welding, and because of the substantial labor involved in welding the gates to the wax patterns, processing time and expense were significantly increased.

Significant labor was involved in ensuring an adequate seal, having no air pockets or undercuts, at the junctions between the gates and the runner bar or the wax pattern. This was necessary because undercuts can trap sand at the ceramic dipping stage. At the metal pouring stage, the sand particle can break off, and travel into the metal stream, resulting in an "inclusion." Inclusions affect aesthetics, processing time, and the strength of the club head.

At the dipping stage, additional gates to the toe, ribbon, and crown created at least two disadvantages. First, additional ceramic material was required to accommodate the extra surface area of the gates. Second, the additional gates aggravated a problem known as ceramic bridging, wherein ceramic material fills the area between two gates, leading to heat retention problems in the metal pouring stage.

The number and location of additional gates also complicated final processing, resulting in additional polishing, cutting, and other labor-intensive processing. For example, after the metal head is formed, additional gates allow ceramic material to cling more readily to the metal part, impeding its removal. In addition, when club heads are removed from the assembly, it is customary to use a bandsaw to cut through the metal gates. Cutting through many gates in varied locations with a bandsaw is labor intensive, time consuming, expensive and dangerous.

Once the gates were cut off, the areas of the club head where the gates were located required two stages of abrasive grinding, the first to remove stock, the second to blend the gate to the shape of the surrounding contour. This was time consuming and expensive and required excellent polishing skills in blending. If the blending was not done properly it could leave flat spots or thin spots which could result in scrapping a part. The abrasive belts used in these operations are very expensive and represent a substantial cost in manufacturing metal wood golf club heads.

Another problem associated with gating methods employed in the past was the lack of consistency in face curvature and sole plate fit. In the past, the sole plate orifice was prone to deformation, resulting in variation from piece to piece and poor or inconsistent sole plate fit. Deformation of the face has also been problematic in the past. Tooling creates the initial curvature of the wax pattern face. But removing the core from the wax pattern creates a slight vacuum, which tends to pull the face inward and to reduce its curvature. Contraction associated with the cooling of the molten metal tends to aggravate this effect.

In the past, the face deformation problem was compounded during the metal cooling stage due to stress generated by contraction of the head and gates during the cooling of the metal. Variations in the number of gates and their location combined to make the consistency of the final curvature unpredictable.

Thus, there is a need for an apparatus for casting metal wood golf club heads that employs a gating system that is cut directly into tooling, that results in suitable metal distribution and cooling patterns within the golf club head, that reduces or eliminates the occurrence of undercuts, that controls face curvature and sole plate orifice deformation, that does not suffer adverse effects from ceramic bridging, and that simplifies processing of the wax pattern and the unfinished metal golf club head.

SUMMARY OF THE INVENTION

The apparatus of the present invention overcomes the above-mentioned disadvantages and drawbacks which are characteristic of the prior art. The apparatus of the present invention creates and employs a club head wax pattern having integral gating on its weld rim.

Preferred embodiments of the present invention include a wax pattern, a mold assembly, a ceramic mold, tooling, and an unfinished metal club head for use in connection with investment casting of a metal wood golf club head, each said embodiment featuring weld rim gating.

In a preferred embodiment, gating is cut directly and completely into the tooling, simplifying processing of the wax pattern, eliminating the need for additional processing to add gates, and reducing or eliminating undercuts by minimizing the number of wax welds needed. The only wax welds needed are those used to attach the wax pattern to the runner bar, and they are formed using a single dip seal making undercuts less likely. The gating arrangement allows the wax pattern to be easily connected to a runner bar and improves physical access to the mold assembly.

The gating of the present invention also results in suitable metal distribution and cooling patterns within the golf club and avoids adverse ceramic bridging and pitting. With the apparatus of the present invention, the gates and the hollow interior of the club head centralize heat retention to form a heat source relative to the cool air outside the crown of the head. This is true even if ceramic bridging occurs across the gates. Accordingly, the crown cools uniformly from the outside surface to the inside surface, and the opportunity for pockets to form and for shrink to occur is substantially reduced. Where shrink does occur, it is on the inside of the crown and does not require weld repair and additional polishing.

With regard to processing, the apparatus of the present invention allows removal of each unfinished club head from the mold assembly, and removal of all gates from the unfinished metal golf club head with a single saw cut orientation, increasing safety and efficiency. In addition, weld rim gating dispenses with the need for a second grinding stage, in that the gates are rough ground only. The remainder of the Sate which is normally removed by blending is melted into the sole plate weld. The subsequent polishing of the weld area is required in any event and eliminates expensive duplication of grinding and polishing.

With regard to deformation of the face, the cooling characteristics of the apparatus of the present invention result in more consistent solidification of the metal, allowing greater consistency of the bulge and roll of the final product. The fact that the gating of the present invention is in full contact with the fence and is locked to the runner bar provides additional control over bulge and roll and enhances face quality by increasing the gating contact surface and ensuring greatly improved casting quality.

With regard to the deformation of the sole plate opening, the gates are disposed immediately adjacent to the sole plate opening, and are locked to the runner bar during casting. This reduces distortion and provides much greater consistency.

In a preferred embodiment of the present invention, the tooling for creating a wax pattern comprises two half molds, each having a shape complementary to approximately one half of the golf club head, such that when the two mold halves are placed together a wax pattern cavity having the shape of a golf club head is formed. Gating cavities are disposed around the portion of the wax pattern cavity corresponding to the weld rim of the club head.

A collapsible core, having a shape complementary to the interior surface of the club head is inserted within the wax pattern cavity. The core is supported within the cavity by a shaft,, known as the "core pedestal," which is rigidly held by a complementary portion of the mold halves known as the "core print."

When the mold halves are brought together with the core therebetween, the wax pattern cavity is sealed save for a wax injection channel. Wax is introduced and allowed to at least partially solidify, after which the mold halves are separated and the wax pattern is removed. The core is then disassembled and removed through the sole orifice of the wax pattern as is well-understood in the art.

A preferred mold assembly of the present invention includes an improved wax runner bar and wax pattern arrangement for the ceramic dipping stage. A preferred embodiment of the runner bar of the present invention includes a ledge for each wax pattern that conforms to the orientation of the wax pattern gates. The ledge defines a central opening below the orifice of each wax pattern to facilitate drying of the inside of the head after the dipping stage.

In a preferred embodiment, the runner bar is symmetric about a central hub, which is also the entry point for molten metal. Wax patterns are placed on the runner bar such that their respective hosels point toward the hub. This arrangement results in beneficial central heat retention effects, such as allowing molten metal to completely fill the mold cavity before significant cooling of the hosels, and associated solidification, takes place.

Numerous objects, features and advantages of the present invention will be readily apparent to those of ordinary skill in the art upon a reading of the following detailed description of presently preferred but nonetheless illustrative embodiments of the present invention when taken in conjunction with the accompanying drawings.

DESCRIPTION OF THE PREFERRED EMBODIMENTS

Figure 2:
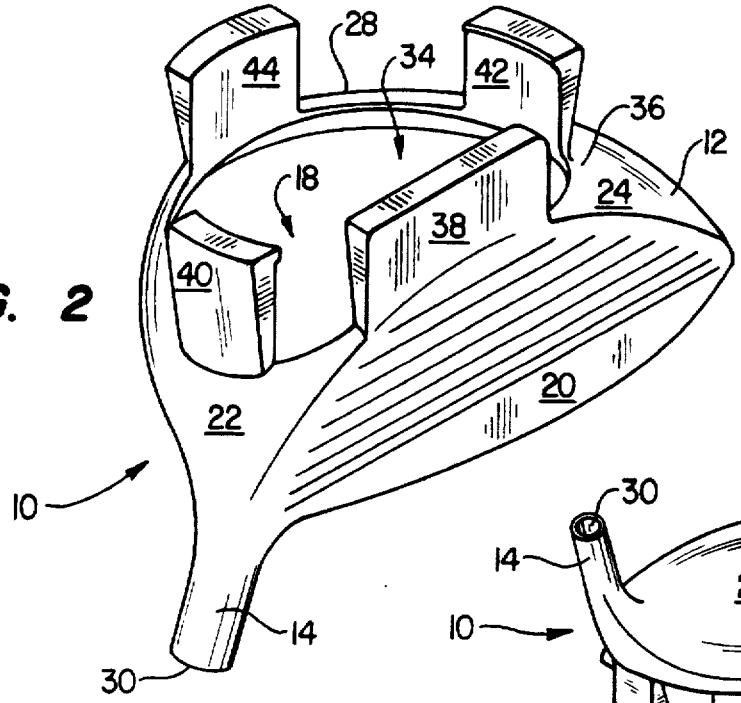
FIG. 2 is a perspective view of a wax pattern according to the present invention.
Figure 3:
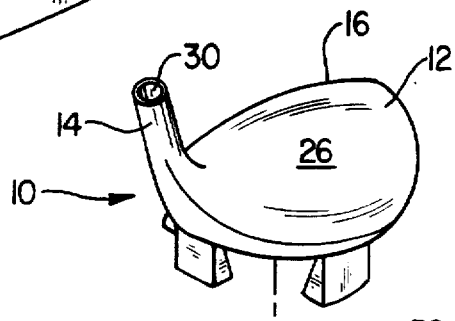
FIG. 3 is a perspective view of a mold assembly according to the present invention.
Figure 3:
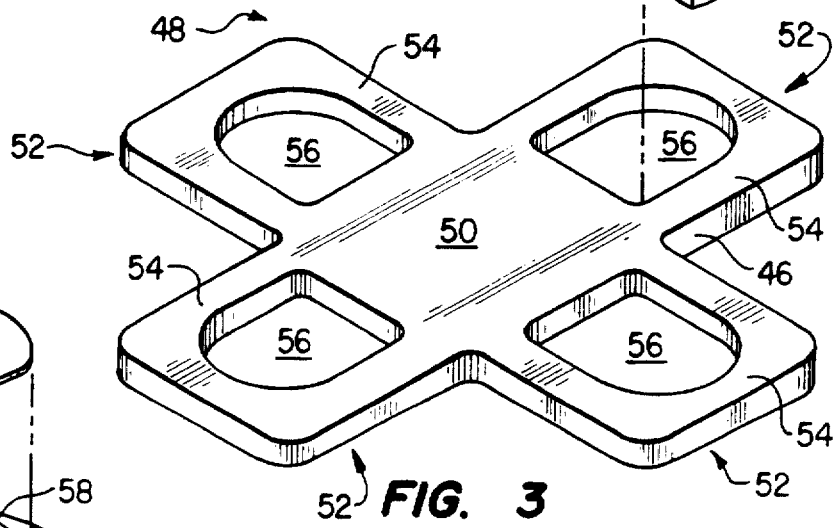

Referring now to the drawings, and particularly to FIGS. 2 and 3, a wax pattern according to the present invention, is shown and generally designated by the reference numeral 10.

Figure 4:
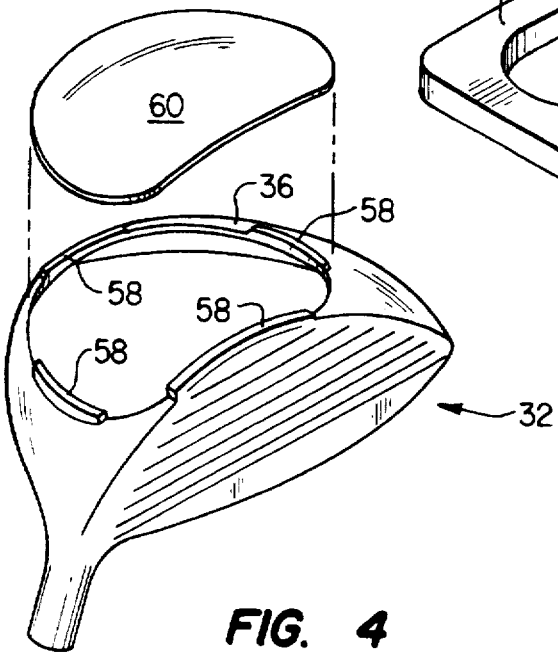
FIG. 4 is a perspective view of an unfinished golf club head according to the present invention.

In a preferred embodiment, the wax pattern 10 comprises a main body 12, having a hosel 14 extending from its exterior surface 16, and having a hollow interior 18. The main body 12 is characterized by a face 20, a heel, 22, a toe 24, a crown 26, and a ribbon 28. The hosel 14 is open at its free end 30 such that a metal duplicate 32 of the wax pattern 10, shown in FIG. 4, may receive and be secured to a golf club shaft (not shown).

An orifice 34 bounded by a weld rim 36 is disposed in the main body 12 below the crown 26, and adjacent to the face 20, heel 22, toe 24 and ribbon 28. In a preferred embodiment, four gates extend from the weld rim 36, including a primary gate 38 that feeds the face 20, and three secondary gates 40, 42, 44 that feed the heel 22, toe 24, and ribbon 28 areas respectively. Those of ordinary skill in the art will recognize that more or less gates may be employed depending on metal flow constraints.

In a preferred embodiment, several wax patterns 10 are affixed to a runner bar 46 to form a mold assembly 48, shown in FIG. 3, which is attached to a cup (not shown) for introduction of molten metal at a later stage. In a preferred embodiment, the runner bar 46 comprises a central hub 50 and four symmetric projections 52 in a clover pattern. Each projection 52 comprises a ledge 54, adapted to align with each gate 38–44 of a wax pattern 10, and an aperture 56 aligned below the wax pattern orifice 34. Those of ordinary skill in the art will recognize that the runner bar 46 may have more or less projections.

When the mold assembly 48 is completed, a mold (not shown) is prepared according to standard investment casting techniques by coating the mold assembly 48 with a ceramic solution and sand, such that the mold is a negative duplicate of the wax pattern 10, and such that gate channels are formed around the gates 38–44.

In a preferred embodiment, an unfinished club head 32 is formed by pouring molten metal through the gate channels into the mold, and allowing the metal to cool. The unfinished club head 32 is a positive duplicate of the wax pattern 10. The unfinished club head 32 is completed by removing and rough-grinding gates 38–44. The remaining material 58 on the weld rim 36 is melted into a sole plate weld (not shown), created when a sole plate 60 is welded to the weld rim 36 so as to cover the orifice 34. The weld is subsequently polished, completing gate removal.

Figure 1:
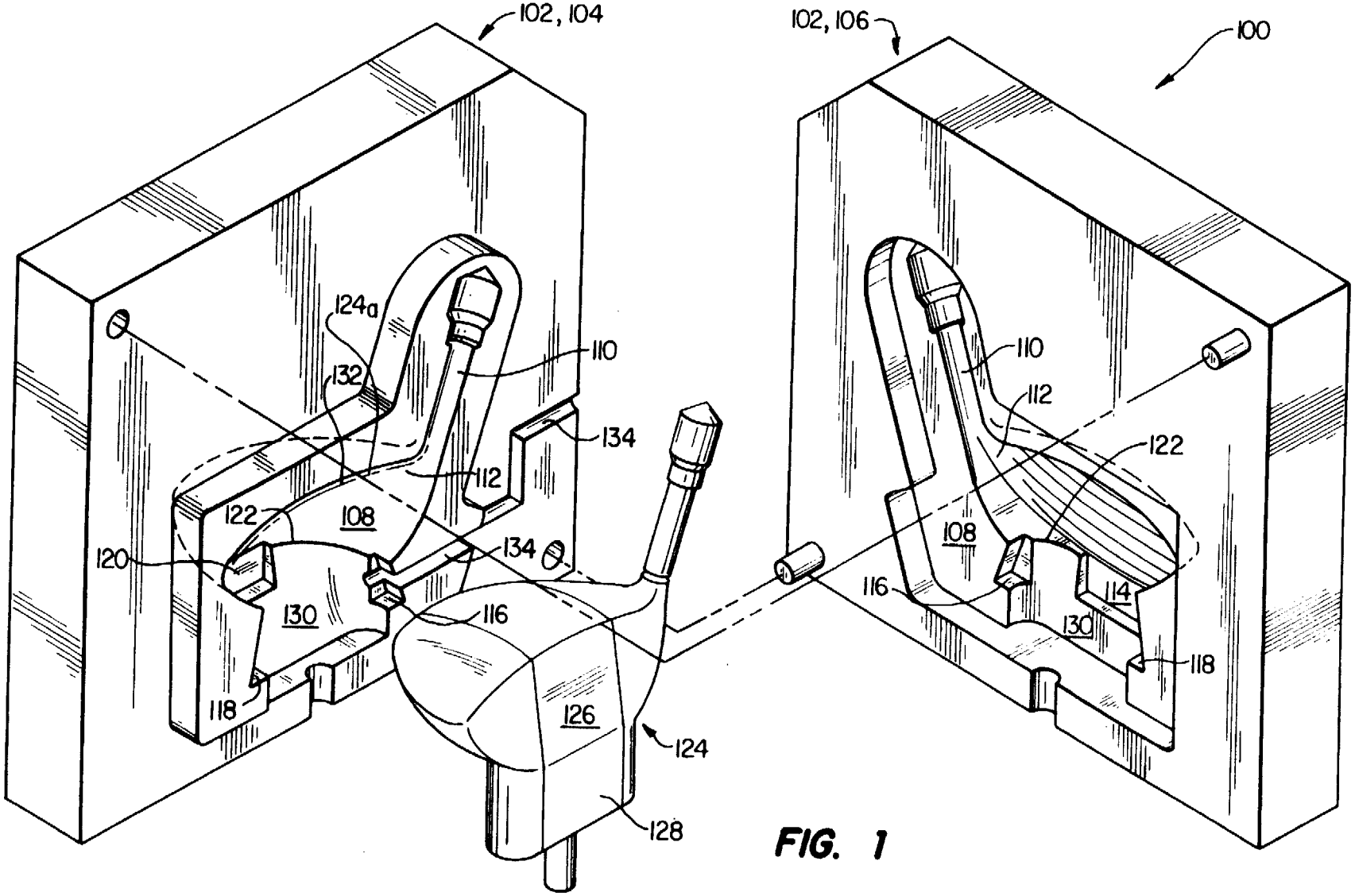
FIG. 1 is an exploded perspective view of tooling according to the present invention.

Referring now to FIG. 1, a tooling assembly according to the present invention is shown and generally designated by the reference numeral 100.

In a preferred embodiment, the tooling assembly 100 comprises a two-part tooling body 102, having a first half 104 and a second half 106, surrounding a wax pattern cavity 108 which is the duplicate in shape of the wax pattern 10 shown in FIGS. 2 and 3. Cavity portions 110 form the hosel 14 and cavity portions 112 form the exterior surface 16 of the body 12. The face gate 38, heel gate 40, toe gate 42 and ribbon gate 44 are formed by gating cavities 114–120 respectively. The gating cavities 114–120 are disposed at the portion 122 of the wax pattern cavity 108 complementary to the weld rim 36 of the wax pattern 10.

In a preferred embodiment, the tooling further comprises a collapsible core 124 having a main body 126 complementary to the interior of the wax pattern 10, and having a core pedestal 128, having a circumference complementary to the shape of orifice 34 and extending downward from the main body 126. A complementary portion 130 of the wax pattern cavity 108 accommodates the pedestal 128.

The core 124 is adapted to be removably placed and supported within the wax pattern cavity 108, wherein its position relative to the wax pattern cavity is shown by phantom lane **124*a*, wherein a gap 132 corresponding to the thickness of the body 12 and hosel 14 walls is left between the core 124 and the wax pattern cavity 108. A channel 134 in the tooling body 102 allows injection of wax into the wax pattern cavity 108 and gating cavities 114–120**.

In operation of the tooling assembly 100 of the present invention, the two halves 104, 106 of the tooling assembly 100 are separated exposing the wax pattern cavity 108. The core 124 is placed, and supported within the cavity 108 and the two halves 104, 106 are reassembled. Wax is introduced into the wax injection channel 134 and fills gating cavities 114–120 and the gap 132 between the core 124 and the wax pattern cavity 108. When the wax cools and solidifies, the two halves 104, 106 of the tooling assembly are again separated and the wax pattern 10 and core 124 are removed. The core 124 is then collapsed and withdrawn from the wax pattern 10 through the orifice 34.

Those of ordinary skill in the art will recognize that the tooling 100 may also include other cavities to allow simultaneous production of more than one club head wax pattern or to allow simultaneous production of other parts such as the sole plate 60.

While the present invention has been described in detail and with reference to specific embodiments thereof, it will be apparent to one of ordinary skill in the art that various modifications can be made therein without departing from the spirit and scope of the invention and the appended claim which are intended to cover all such modifications.

What is claimed is:

1. A metal body for use in connection with investment casting of a metal wood golf club head comprising:

a) a body having a hollow interior accessible through an orifice and a weld rim surrounding said orifice; and b) gating means comprising at least one gate disposed on said weld rim.

2. The metal body of claim 1 wherein said gating means comprises four gates.

3. A metal body for use in connection with investment casting of a metal wood golf club head comprising:

a) a body comprising a face, a toe, a heel, and a ribbon, and having a hollow interior accessible through an orifice disposed adjacent to said toe, heel, crown, and ribbon, and a weld rim surrounding said orifice; and b) first, second, third and fourth gates disposed on said weld rim, wherein said first gate is adjacent to said face, said second gate is adjacent to said toe, said third gate is adjacent to said heel, and said fourth gate is adjacent to said ribbon.

* * * * *

UNITED STATES PATENT AND TRADEMARK OFFICE

CERTIFICATE OF CORRECTION

PATENT NO. : 5,538,798

DATED : July 23, 1996

INVENTOR(S) : John P. Sheehan

It is certified that error appears in the above-indentified patent and that said Letters Patent is hereby corrected as shown below:

Column 4, line 35, change "fence" to -- face --.

Column 7, line 3, change "claim" to -- claims --.

Signed and Sealed this

Twenty-ninth Day of October 1996

*Attest:*

Bruce Lehman

BRUCE LEHMAN

*Attesting Officer*

*Commissioner of Patents and Trademarks*